US006557179B1

(12) United States Patent
Reuven

(10) Patent No.: US 6,557,179 B1
(45) **Date of Patent: *May 6, 2003**

(54) COMPARTMENTAL HAIR CAP

(76) Inventor: Michelle G. Reuven, 4219 E. 4TH St. #5, Long Beach, CA (US) 90814

( * ) Notice: Subject to any disclaimer, the term of this patent is extended or adjusted under 35 U.S.C. 154(b) by 0 days.

This patent is subject to a terminal disclaimer.

(21) Appl. No.: 09/815,708

(22) Filed: Mar. 23, 2001

Related U.S. Application Data

(63) Continuation-in-part of application No. 09/564,734, filed on May 4, 2000, now Pat. No. 6,237,154.

(51) Int. Cl.[7] ..... A42B 1/00

(52) U.S. Cl. ..... 2/171.2; 2/204; 2/209; 607/109

(58) Field of Search ..... 2/171.2, 202, 209.13, 2/204, 171, 7, 209, 174; 607/109, 110; 126/204

(56) References Cited

U.S. PATENT DOCUMENTS 2,983,925 A * 5/1961 Gettinger ..... 2/204
3,070,803 A 1/1963 Slepicka
4,552,149 A 11/1985 Tatsuki
4,581,773 A * 4/1986 Cunnane ..... 2/204
4,776,324 A * 10/1988 Clarres ..... 128/76
4,854,319 A 8/1989 Tobin
5,005,374 A * 4/1991 Spitler ..... 62/259.3
5,327,585 A * 7/1994 Karlan ..... 2/7
5,395,400 A * 3/1995 Stafford et al. ..... 607/109
5,605,144 A * 2/1997 Simmons et al. ..... 126/204
5,606,746 A * 3/1997 Shelton et al. ..... 2/102
5,950,023 A 9/1999 Hara et al.
5,950,234 A * 9/1999 Leong et al. ..... 2/7
5,957,964 A 9/1999 Ceravolo

* cited by examiner

*Primary Examiner*—John J. Calvert
*Assistant Examiner*—Katherine Moran

(57) ABSTRACT

A compartmental hair cap for providing heat or cold to a user's head. The compartmental hair cap includes a cap member comprising an interior layer and an exterior layer. The interior layer of the cap member forming a head cavity. The cap member comprises a lower edge. The cap member comprises an upper edge extending between opposite ends of the lower edge. The interior layer is coupled to the exterior layer along the lower edge of the cap member. The interior layer is coupled to the exterior layer along a plurality of connection lines for coupling the interior layer to the exterior layer to form a plurality of pockets between the interior layer and the exterior layer. Each of the pockets comprises an associated interior space. A plurality of flexible containers each being positionable in an associated one of the pockets. Each of the plurality of flexible containers comprises a thermo-retentive material therein.

19 Claims, 6 Drawing Sheets

COMPARTMENTAL HAIR CAP

REFERENCE TO RELATED APPLICATIONS

This application is a continuation-in-part of my prior United States utility patent application Ser. No. 09/564,734, now U.S. Pat. No. 6,237,154, filed May 4, 2000.

BACKGROUND OF THE INVENTION

1. Field of the Invention

The present invention relates to multi-chambered caps and more particularly pertains to a new compartmental hair cap for providing heat or cold to a user's head.

2. Description of the Prior Art

The use of multi-chambered caps is known in the prior art. More specifically, multi-chambered caps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,070,803; U.S. Pat. No. 4,552,149; U.S. Pat. No. 4,854,319; U.S. Pat. No. 5,605,144; and U.S. Pat. No. 5,957,964.

While these devices fulfill their respective, particular objectives and requirements, the aforementioned patents do not disclose a new compartmental hair cap. The inventive device includes a cap member comprising an interior layer and an exterior layer. The interior layer of the cap member forming a head cavity adapted for receiving a portion of the head of the wearer. The cap member comprises a lower edge adapted for positioning to extend around a back of a wearer's head when the portion of the head of the wearer is received in the head cavity. The cap member comprises an upper edge adapted for positioning to extend between opposite ends of the lower edge and around an upper periphery of the wearer's face when the portion of the head of the wearer is received in the head cavity. The interior layer is coupled to the exterior layer along the lower edge of the cap member. The interior layer is coupled to the exterior layer along a plurality of connection lines for coupling the interior layer to the exterior layer to form a plurality of pockets between the interior layer and the exterior layer. Each of the pockets comprises an associated interior space. A plurality of flexible containers each being positionable in an associated one of the pockets. Each of the plurality of flexible containers comprises a thermo-retentive material.

In these respects, the compartmental hair cap according to the present invention substantially departs from the conventional concepts and designs of the prior art, and in so doing provides an apparatus primarily developed for the purpose of providing heat or cold to a user's head.

SUMMARY OF THE INVENTION

In view of the foregoing disadvantages inherent in the known types of multi-chambered caps now present in the prior art, the present invention provides a new compartmental hair cap construction wherein the same can be utilized for providing heat or cold to a user's head.

The general purpose of the present invention, which will be described subsequently in greater detail, is to provide a new compartmental hair cap apparatus and method which has many of the advantages of the multi-chambered caps mentioned heretofore and many novel features that result in a new compartmental hair cap which is not anticipated, rendered obvious, suggested, or even implied by any of the prior art multi-chambered caps, either alone or in any combination thereof.

To attain this, the present invention generally comprises a cap member comprising an interior layer and an exterior layer. The interior layer of the cap member forming a head cavity adapted for receiving a portion of the head of the wearer. The cap member comprises a lower edge adapted for positioning to extend around a back of a wearer's head when the portion of the head of the wearer is received in the head cavity. The cap member comprises an upper edge adapted for positioning to extend between opposite ends of the lower edge and around an upper periphery of the wearer's face when the portion of the head of the wearer is received in the head cavity. The interior layer is coupled to the exterior layer along the lower edge of the cap member. The interior layer is coupled to the exterior layer along a plurality of connection lines for coupling the interior layer to the exterior layer to form a plurality of pockets between the interior layer and the exterior layer. Each of the pockets comprises an associated interior space. A plurality of flexible containers each being positionable in an associated one of the pockets. Each of the plurality of flexible containers comprises a thermo-retentive material therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new compartmental hair cap apparatus and method which has many of the advantages of the multi-chambered caps mentioned heretofore and many novel features that result in a new compartmental hair cap which is not anticipated, rendered obvious, suggested, or even implied by any of the prior art multi-chambered caps, either alone or in any combination thereof.

It is another object of the present invention to provide a new compartmental hair cap which may be easily and efficiently manufactured and marketed.

It is a further object of the present invention to provide a new compartmental hair cap which is of a durable and reliable construction.

An even further object of the present invention is to provide a new compartmental hair cap which is susceptible of a low cost of manufacture with regard to both materials and labor, and which accordingly is then susceptible of low prices of sale to the consuming public, thereby making such compartmental hair cap economically available to the buying public.

Still yet another object of the present invention is to provide a new compartmental hair cap which provides in the apparatuses and methods of the prior art some of the advantages thereof, while simultaneously overcoming some of the disadvantages normally associated therewith.

Still another object of the present invention is to provide a new compartmental hair cap for providing heat or cold to a user's head.

Yet another object of the present invention is to provide a new compartmental hair cap which includes a cap member comprising an interior layer and an exterior layer. The interior layer of the cap member forming a head cavity adapted for receiving a portion of the head of the wearer. The cap member comprises a lower edge adapted for positioning to extend around a back of a wearer's head when the portion of the head of the wearer is received in the head cavity. The cap member comprises an upper edge adapted for positioning to extend between opposite ends of the lower edge and around an upper periphery of the wearer's face when the portion of the head of the wearer is received in the head cavity. The interior layer is coupled to the exterior layer along the lower edge of the cap member. The interior layer is coupled to the exterior layer along a plurality of connection lines for coupling the interior layer to the exterior layer to form a plurality of pockets between the interior layer and the exterior layer. Each of the pockets comprises an associated interior space. A plurality of flexible containers each being positionable in an associated one of the pockets. Each of the plurality of flexible containers comprises a thermo-retentive solution therein.

Still yet another object of the present invention is to provide a new compartmental hair cap that allows a user to provide heat to the hair of a user for coloring and styling of the hair without the use of a forced air dryer.

Even still another object of the present invention is to provide a new compartmental hair cap that aids the penetration of heated hair and scalp treatments.

Even still another object of the present invention is to provide a new compartmental hair cap that provides cooling to the head of a user to aid in the soothing of a headache.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
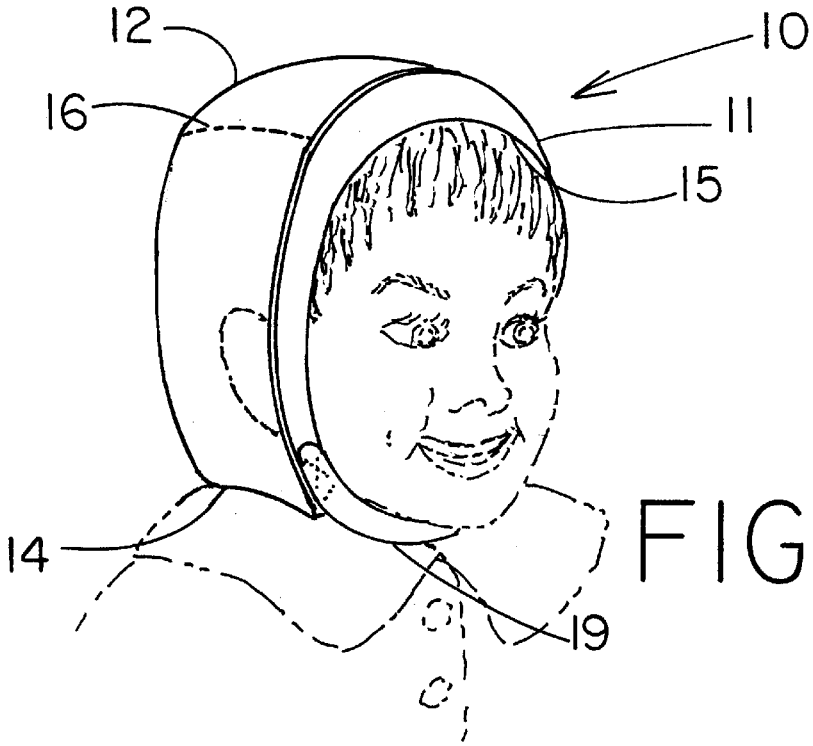
FIG. 1 is a perspective view of a new compartmental hair cap according to the present invention.
Figure 2:
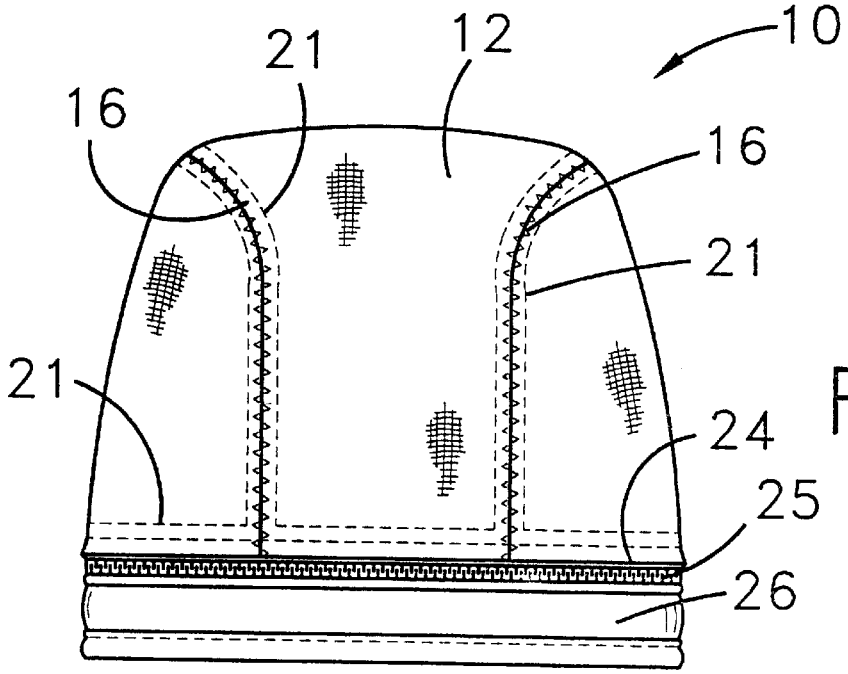
FIG. 2 is a top plan view of the present invention.
Figure 3:
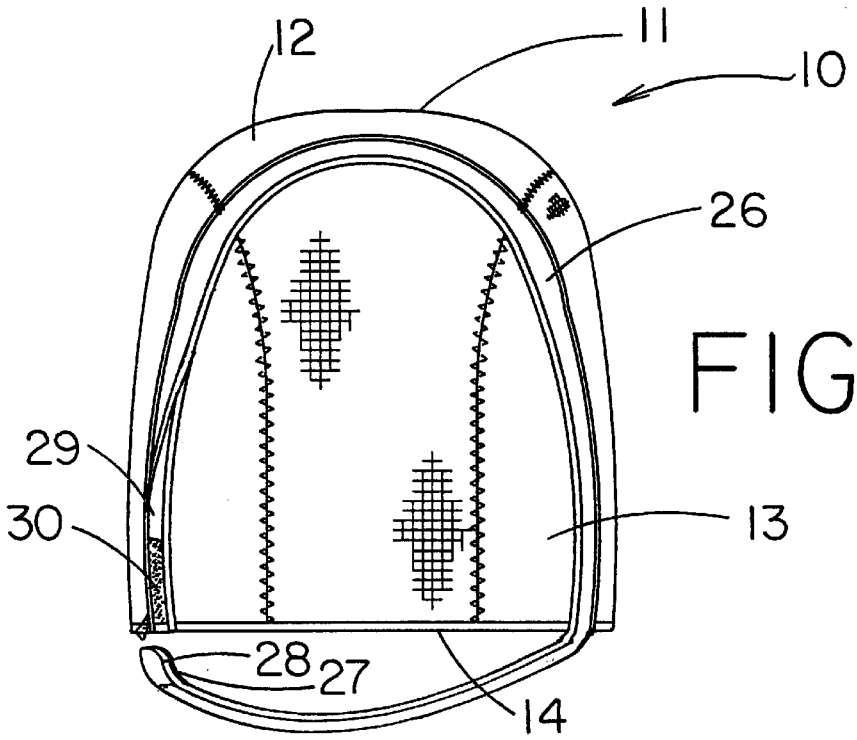
FIG. 3 is a front elevation view of the present invention.
Figure 5:
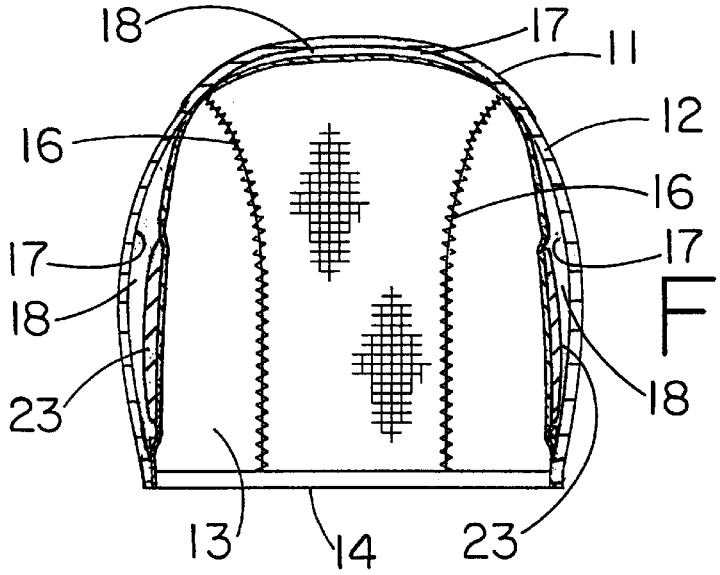
FIG. 5 is a cross-sectional view of the present invention taken along line 5—5 of FIG. 4.
Figure 4:
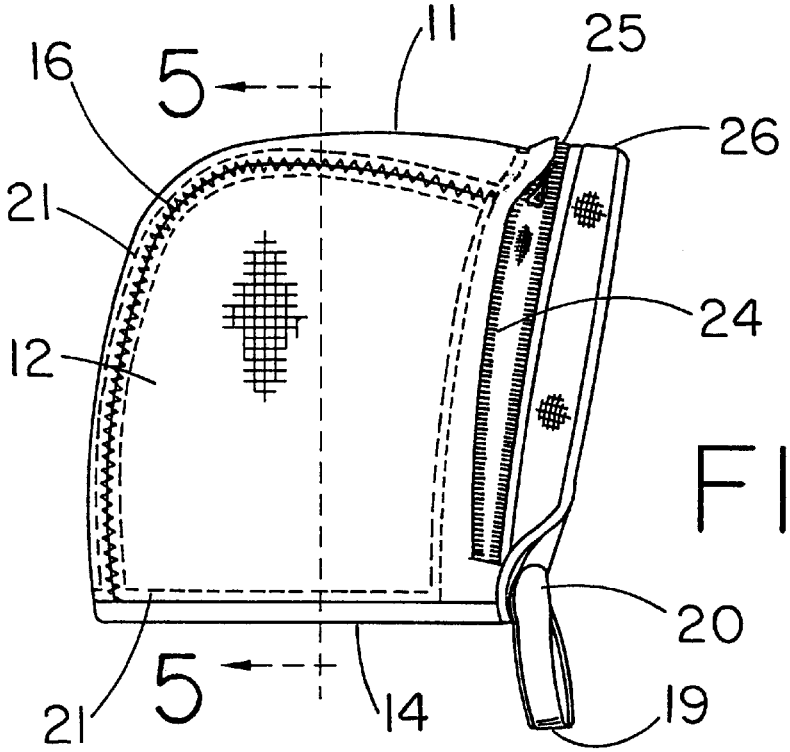
FIG. 4 is a side elevation view of the present invention.
Figure 6:
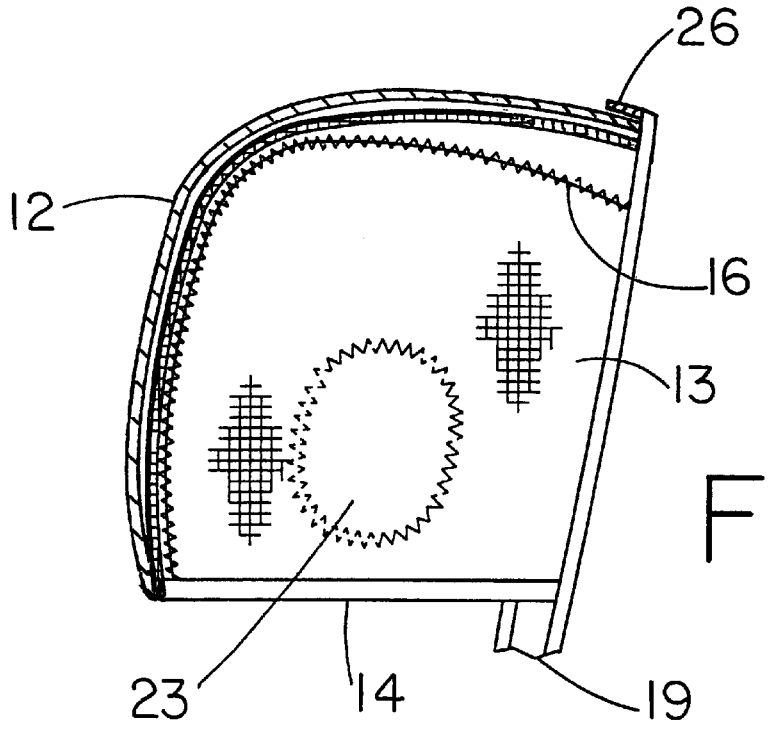
FIG. 6 is a cross sectional view of the present invention.
Figure 7:
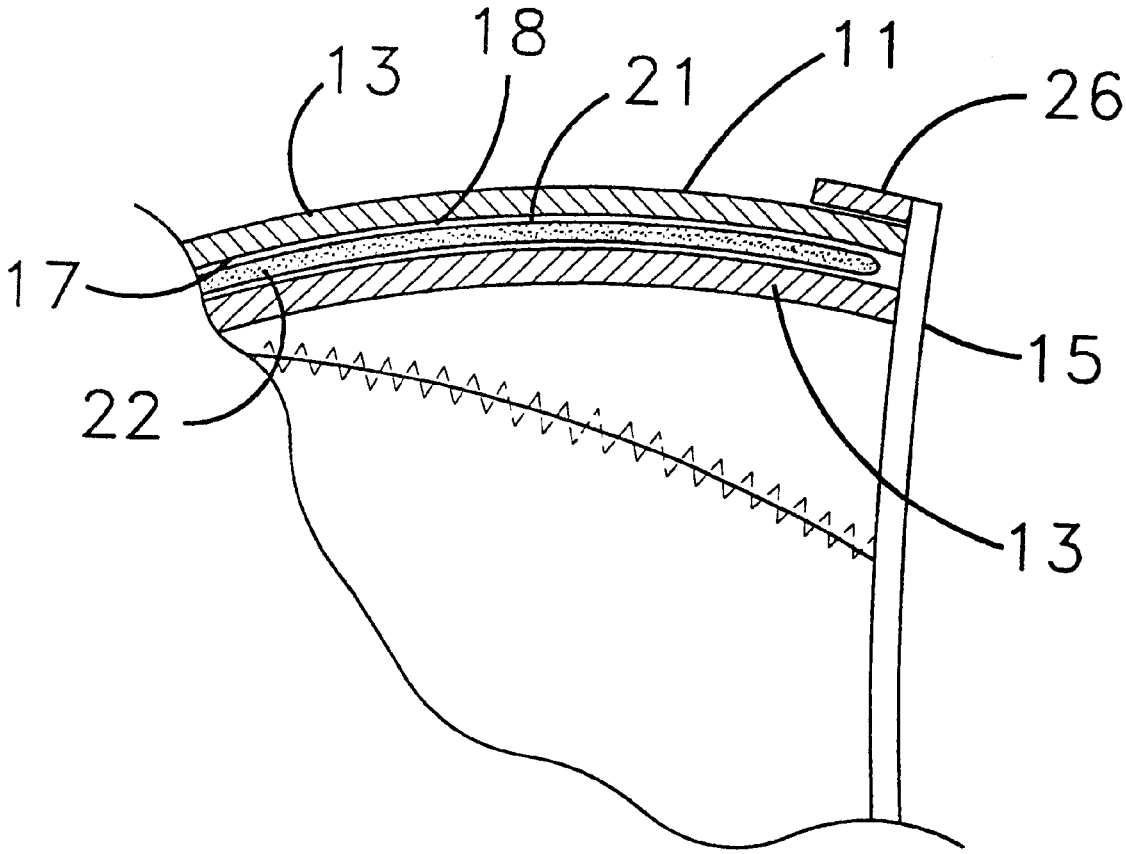
FIG. 7 is an enlarged cross sectional view showing the containers within the pockets of the present invention.
Figure 8:
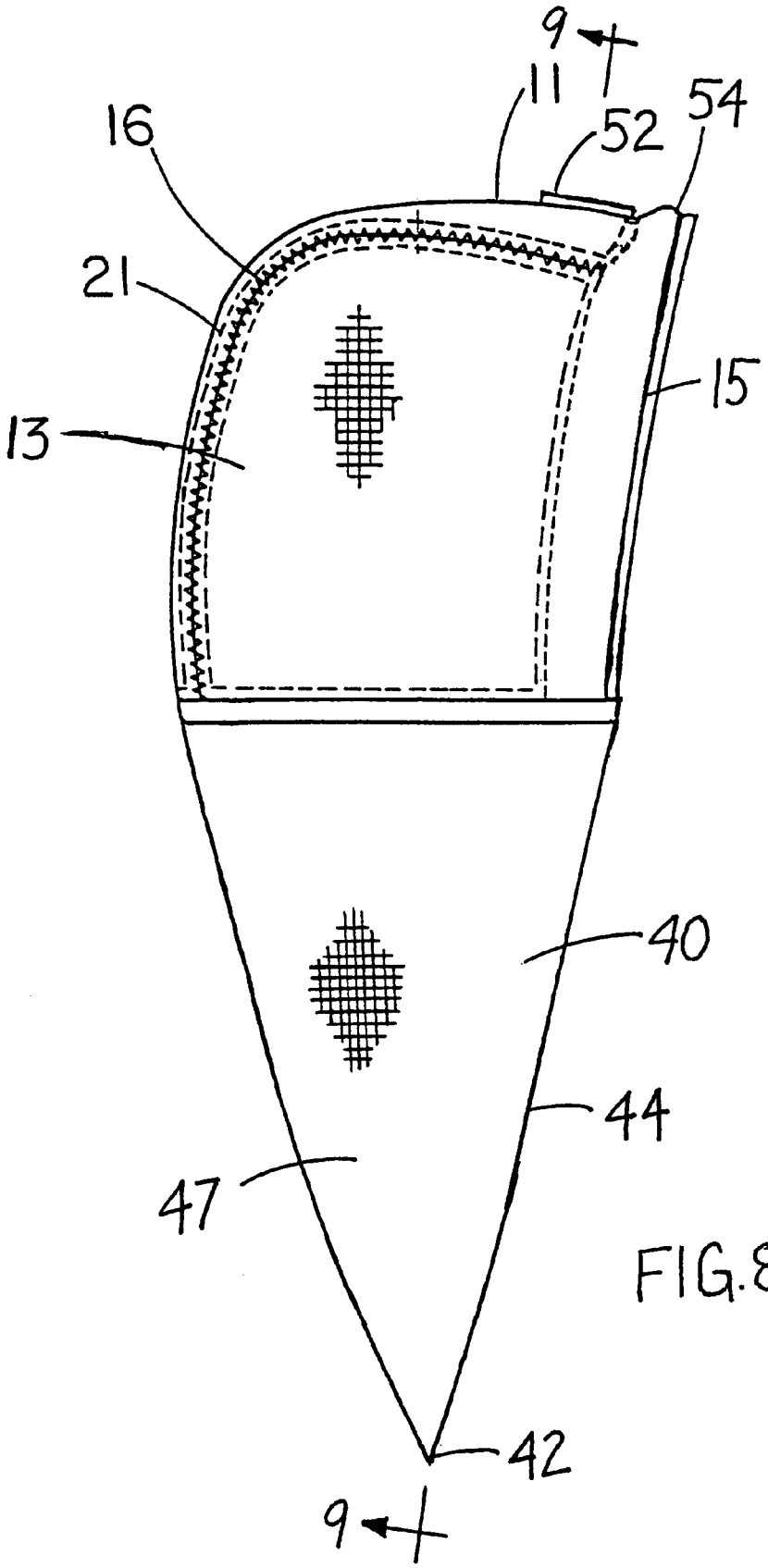
FIG. 8 is a side view of the cap member particularly illustrating the cap member with the optional tail.
Figure 9:
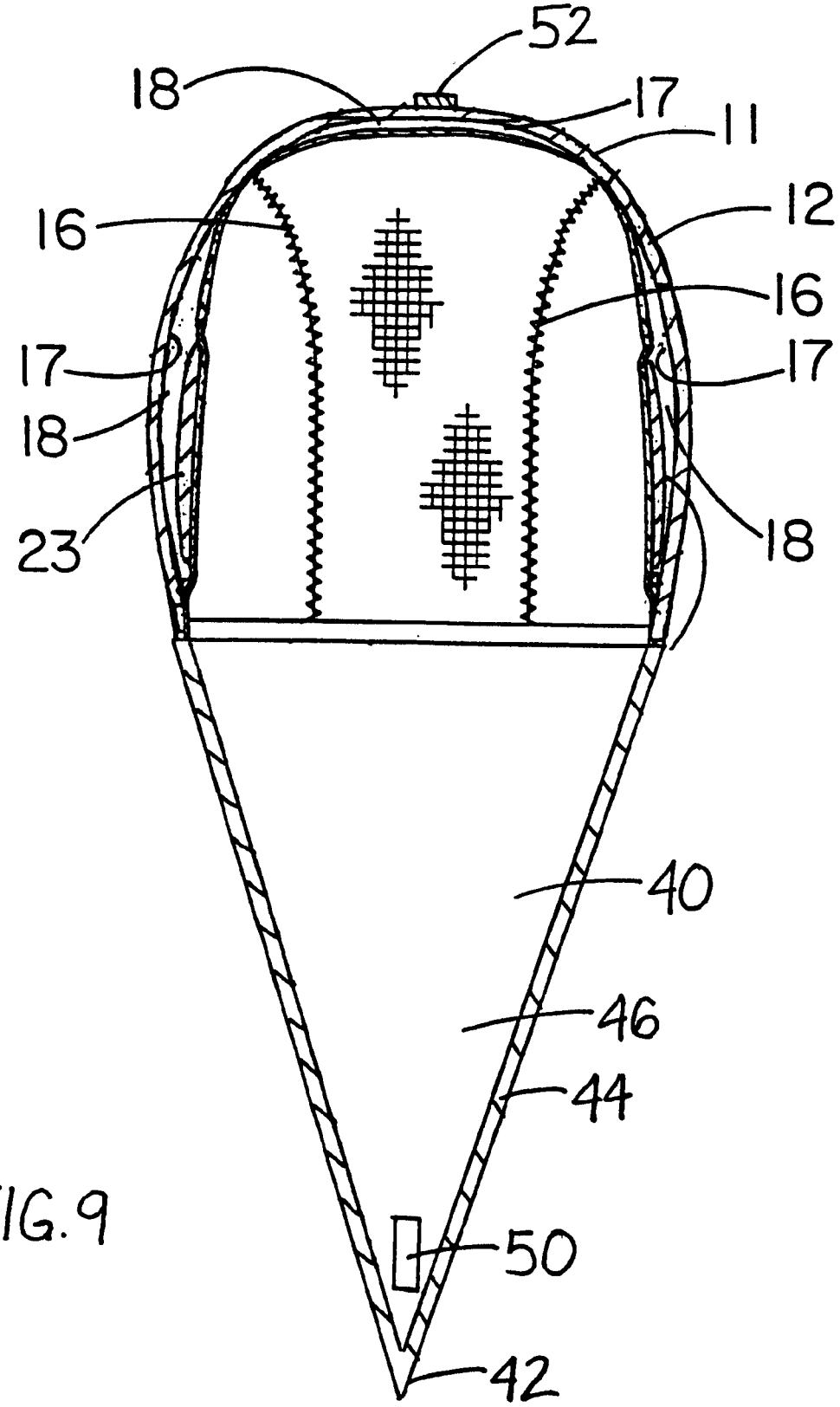
FIG. 9 is a sectional view of the present invention taken along line 9—9 of FIG. 8.

With reference now to the drawings, and in particular to FIGS. 1 through 9 thereof, a new compartmental hair cap embodying the principles and concepts of the present invention and generally designated by the reference numeral 10 will be described.

As best illustrated in FIGS. 1 through 7, the compartmental hair cap 10 generally comprises a cap member 11 having an interior layer 12 and an exterior layer 13. The interior layer of the cap member forms a head cavity adapted for receiving a portion of the head of the wearer. The cap member comprises a lower edge 14 adapted for positioning to extend around a back of a wearer's head when the portion of the head of the wearer is received in the head cavity. The cap member comprises an upper edge 15 adapted for positioning to extend between opposite ends of the lower edge and around an upper periphery of the wearer's face when the portion of the head of the wearer is received in the head cavity.

The interior layer is coupled to the exterior layer along the lower edge of the cap member. The interior layer is coupled to the exterior layer along a plurality of connection lines 16 for coupling the interior layer to the exterior layer to form a plurality of pockets 17 between the interior layer and the exterior layer. The plurality of connection lines is two connection lines. Each connection line extends inwardly from the lower edge towards the upper edge to form two side pockets and a central pocket positioned between the two side pockets. Each of the pockets comprises an associated interior space 18.

Optionally, an elongate flexible strap member 19 may be provided on the cap member. The strap member 19 extends from the cap member. The flexible strap member comprises a distal end 20 couplable to the cap member whereby the flexible strap member is adapted for securing the cap member to the head of the wearer. The flexible strap member is stretchable along its length to help hold the cap member to the portion of the head inserted into the head cavity of the cap member.

A plurality of flexible containers 21 each being positionable in an associated one of the pockets. Each of the plurality of flexible containers comprises a thermo-retentive material 22 therein. The thermo-retentive material is capable of being heated or cooled and maintaining a warm temperature or cool temperature over a period of time. Such materials that are capable of providing such desired results include gels, dry chemical compounds and organic materials. Each of the pockets comprises an opening into the associated interior space, wherein each of the flexible containers is removably insertable into the associated interior space of the associated pocket through the associated opening. Each of the plurality of flexible containers is shaped to correspond to a shape of the associated pocket. In an embodiment, the flexible containers are sealed within the pockets and the entire cap is heated or cooled so that the thermo-retentive material of the flexible containers maintains a desired temperature.

A pair of ear protectors 23 coupled to the interior layer of the cap member such that each ear protector is positioned over an associated ear of the wearer when the portion of the head is received in the head cavity. Each ear protector is coupled to the interior layer inside an associated one of the side pockets whereby the ear protector is positioned between the associated flexible container and the ear of the wearer for protecting the ear of the wearer from temperature emitted by the thermo-retentive material in the associated flexible container.

An exterior opening 24 in the exterior layer is positioned proximate the upper edge of the cap member. The exterior opening is positioned adjacent to each opening into the plurality of pockets. A closure 25 for selectively closing the exterior opening whereby the flexible containers are securable within the plurality of pockets when the closure is in a closed position. The closure may optionally comprise a continuous closure structure, such as for example, a zipper, and may optionally comprise a plurality of closure structures, such as, for example, hook and loop fastener segments.

The flexible strap member may include a flap portion 26. The flap portion is coupled to the cap member along the upper edge of the cap member. The flap member extends from the upper edge of the cap member for positioning over the closure.

A first connection portion 27 is coupled to a first end 28 of the strap member. A second connection portion 30 is coupled to a second end 29 of the flap portion. The second connection portion is selectively engageable to the first connection portion whereby the strap member forms a loop for holding the cap member on the head of the wearer.

The exterior layer of the cap member and each of the ear protectors is constructed of neoprene rubber or other materials suitable for use in a microwave for retaining heat generated in a microwave. The interior layer of the cap member is constructed of a material chosen from the group of materials consisting of lycra, nylon, and spandex or other materials suitable for use in a microwave for retaining heat generated in a microwave.

Optionally, a tail 40 (see FIGS. 8 and 9) may be provided on the cap member for securing the cap member to the user's head in a turban-style manner. The tail 40 extends from the lower edge 14 of the cap member 11. The tail has a free end 42 located at an end of said tail opposite the lower edge of the cap member. The tail 40 has a width that extends in a direction generally parallel to the lower edge, and the width of the tail may taper narrower away from the lower edge toward the free end 42. A portion of the tail adjacent to the lower edge 14 may have a width that is substantially equal to a length of the lower edge, which permits the tail to extend downwardly adjacent to a large portion of the user's neck. The tail 40 has a length measured between the lower edge 14 and the free end 42 of the tail. The width of the tail may be substantially equal to the length of the tail to maximize the length of the tail available for wrapping about the head of the user in a turban-style manner. The tail has a perimeter 44, and in one preferred embodiment of the invention, the perimeter 44 has a substantially triangular shape. The tail has an inner surface 46 for positioning adjacent to a user's neck, and an outer surface 47.

A releasable connector structure may he provided for releasably connecting a portion of the tail 40 to the cap member 11 at a location adjacent to the upper edge 15 of the cap member. The releasable connector structure may comprise first 50 and second 52 connectors that are releasably connectable together. The first connector 50 is mounted on the inner surface 46 of the tail 40 and the second connector 52 is mounted on the cap member 11. The first connector 50 may be located adjacent to the free end 42 of the tail. The second connector 52 is located adjacent to a central location 54 of the upper edge 15 of the cap member. Illustratively, the releasable connectors may comprise hook and loop fasteners.

In use, a user heats or cools the flexible containers and then places the flexible containers into their respective pockets within the cap member. The user would then place their head into the head cavity and secure the strap member under the chin, if the cap member is provided with a strap member. The heat from the containers would then radiate through the interior layer and into the user's hair and scalp. The containers could be cooled and applied the user's scalp to help case headaches. In an alternative the user could leave the containers within their respective pockets and insert the entire cap member into a microwave to heat the cap and the thermo-retentive material within the flexible containers or place the entire cap into the freezer to cool the cap and the thermo-retentive material within the flexible containers. For caps with a tail, the cap may be put on the user's head with the tail positioned adjacent to the back of the neck or adjacent to the forehead of the user. The tail may he twisted along a longitudinal axis thereof to pull the sides of the cap inwardly into a snug relationship with the sides of the head. The free end of the twisted tail may be releasably connected to the connector on the cap for holding the tail in a twisted condition. Optionally, the tail may be manipulated in other ways to help secure the cap member to the head.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention.

I claim:

1. A compartmentalized hair cap, comprising:

a cap member having an interior layer and an exterior layer, said interior layer of said cap member forming a head cavity adapted for receiving a portion of the head of the wearer;

said cap member having a lower edge adapted for positioning to extend around a back of a wearer's bead when the portion of the head of the wearer is received in said head cavity;

said cap member having an upper edge extending between opposite ends of said lower edge and being adapted for positioning to around an upper periphery of the wearer's face when the portion of the head of the wearer is received in said head cavity;

said interior layer being coupled to said exterior layer along said lower edge of said cap member;

said interior layer being coupled to said exterior layer along a plurality of connection lines for coupling said interior layer to said exterior layer to form a plurality of pockets between said interior layer and said exterior layer, each of said pockets having an associated interior space; and a plurality of flexible containers, each flexible container being positionable in an associated one of said pockets, each of said plurality of flexible containers having a thermo-retentive material therein;

a pair of ear protectors coupled to said interior layer of said cap member such that each ear protector is positioned over an associated ear of the wearer when the portion of the head is received in said head cavity;

each ear protector being coupled to said interior layer inside an associated one of said side pockets whereby said ear protector is positioned between said associated flexible container and the ear of the wearer for protecting the ear of the wearer from the temperature of said thermo-retentive material in said associated flexible container.

2. The compartmentalized hair cap of claim 1, further comprising:

a flexible strap member being stretchable along its length to help hold said cap member to the portion of the head inserted into said head cavity of said cap member.

3. The compartmentalized hair cap of claim 1, further comprising:

each of said plurality of flexible containers being shaped to correspond to a shape of said associated pocket.

4. The compartmentalized hair cap of claim 1, further comprising:

said plurality of connection lines being two connection lines, each connection line extending inwardly from said lower edge towards said upper edge to form two side pockets and a central pocket positioned between said two side pockets.

5. A compartmentalized hair cap comprising:

a cap member having an interior layer and an exterior layer, said interior layer of said cap member forming a head cavity adapted for receiving a portion of the head of the wearer;

said cap member having a lower edge adapted for positioning to extend around a back of a wearer's head when the portion of the head of the wearer is received in said head cavity;

said cap member having an upper edge extending between opposite ends of said lower edge and being adapted for positioning to around an upper periphery of the wearer's face when the portion of the head of the wearer is received in said head cavity;

said interior layer being coupled to said exterior layer along said lower edge of said cap member;

said interior layer being coupled to said exterior layer along a plurality of connection lines for coupling said interior layer to said exterior layer to form a plurality of pockets between said interior layer and said exterior layer, each of said pockets having an associated interior space; and a plurality of flexible containers, each flexible container being positionable in an associated one of said pockets, each of said plurality of flexible containers having a thermo-retentive material therein;

an exterior opening in said exterior layer, said exterior opening being positioned proximate said upper edge of said cap member, said exterior opening being positioned adjacent to each opening into said plurality of pockets; and a closure for selectively closing said exterior opening whereby said flexible containers are securable within said plurality of pockets when said closure is in a closed position.

6. The compartmentalized hair cap of claim 5, further comprising:

a flexible strap member having a flap portion being coupled to said cap member along said upper edge of said cap member, said flap portion extending from said upper edge of said cap member for positioning over said closure.

7. The compartmentalized hair cap of claim 6 further comprising:

a first connection portion coupled to a first end of said strap member; and a second connection portion coupled to a second end of said flap portion, said second connection portion being selectively engageable to said first connection portion whereby said strap member forms a loop for holding said cap member on the head of the wearer.

8. A compartmentalized hair cap comprising:

a cap member having an interior layer and an exterior layer, said interior layer of said cap member forming a head cavity adapted for receiving a portion of the head of the wearer;

said cap member having a lower edge adapted for positioning to extend around a back of a wearer's head when the portion of the head of the wearer is received in said head cavity;

said cap member having an upper edge extending between opposite ends of said lower edge and being adapted for positioning to around an upper periphery of the wearer's face when the portion of the head of the wearer is received in said head cavity;

said interior layer being coupled to said exterior layer along said lower edge of said cap member;

said interior layer being coupled to said exterior layer along a plurality of connection lines for coupling said interior layer to said exterior layer to form a plurality of pockets between said interior layer and said exterior layer, each of said pockets having an associated interior space;

a plurality of flexible containers, each flexible container being positionable in an associated one of said pockets, each of said plurality of flexible containers having a thermo-retentive material therein; and a tail extending from the lower edge of said cap member, said tail having a free end located at an end of said tail opposite the lower edge of the cap member;

wherein said tail has a width extending generally parallel to said lower edge, the width of said tail tapering narrower away from said lower edge.

9. The compartmentalized hair cap of claim 8, wherein a portion of said tail has a width substantially equal to a length of said lower edge.

10. The compartmentalized hair cap of claim 8, wherein said tail has a length measured between said lower edge and the free end of said tail, and wherein a maximum width of the said tail being substantially equal to the length of said tail.

11. The compartmentalized hair cap of claim 8, wherein said tail has a perimeter, the perimeter of said tail being substantially triangular.

12. The compartmentalized hair cap of claim 8, further comprising:

a releasable connector structure for releasably connecting a portion of said tail to said cap member at a location adjacent to the upper edge of said cap member.

13. The compartmentalized hair cap of claim 12, wherein said releasable connector structure comprises first and second connectors releasably connectable together, said first connector being mounted on said tail and said second connector being mounted on said cap member.

14. The compartmentalized hair cap of claim 13, wherein said first connector is located adjacent to the free end of said tail, said second connector being located adjacent to a central location of the upper edge of said cap member.

15. A compartmentalized hair cap comprising:

a cap member having an interior layer and an exterior layer, said interior layer of said cap member forming a head cavity adapted for receiving a portion of the head of the wearer;

said cap member having a lower edge adapted for positioning to extend around a back of a wearer's head when the portion of the head of the wearer is received in said head cavity;

said cap member having an upper edge extending between opposite ends of said lower edge and being adapted for positioning to around an upper periphery of the wearer's face when the portion of the head of the wearer is received in said head cavity;

said interior layer being coupled to said exterior layer along said lower edge of said cap member;

said interior layer being coupled to said exterior layer along a plurality of connection lines for coupling said interior layer to said exterior layer to form a plurality of pockets between said interior layer and said exterior layer, each of said pockets having an associated interior space;

a plurality of flexible containers, each flexible container being positionable in an associated one of said pockets, each of said plurality of flexible containers having a thermo-retentive material therein; and a tail extending from the lower edge of said cap member, said tail having a free end located at an end of said tail opposite the lower edge of the cap member; and a releasable connector structure for releasably connecting a portion of said tail to said cap member at a location adjacent to the upper edge of said cap member.

16. The compartmentalized hair cap of claim 15, wherein a portion of said tail has a width substantially equal to a length of said lower edge.

17. The compartmentalized hair cap of claim 15, wherein said tail has a length measured between said lower edge and the free end of said tail, and wherein a maximum width of the said tail being substantially equal to the length of said tail.

18. The compartmentalized hair cap of claim 15, wherein said releasable connector structure comprises first and second connectors releasably connectable together, said first connector being mounted on said tail and said second connector being mounted on said cap member.

19. The compartmentalized hair cap of claim 18, wherein said first connector is located adjacent to the free end of said tail, said second connector being located adjacent to a central location of the upper edge of said cap member.

* * * * *